US012442203B2

(12) United States Patent
Smith

(10) Patent No.: US 12,442,203 B2
(45) Date of Patent: Oct. 14, 2025

(54) CRIMPING TOOL, CRIMPED PIPE WITH FLATTENED END, AND SCAFFOLD LADDER FRAME

(71) Applicant: Grady F. Smith & Co., Inc., Greenville, NC (US)

(72) Inventor: Grady F Smith, Greenville, NC (US)

(73) Assignee: GRADY F. SMITH & CO., INC., Greenville, NC (US)

( * ) Notice: Subject to any disclaimer, the term of this patent is extended or adjusted under 35 U.S.C. 154(b) by 446 days.

(21) Appl. No.: 17/965,503

(22) Filed: Oct. 13, 2022

(65) Prior Publication Data

US 2023/0116722 A1 Apr. 13, 2023

Related U.S. Application Data

(60) Provisional application No. 63/255,126, filed on Oct. 13, 2021.

(51) Int. Cl.

| | |
|---|---|
| ***E04H 12/00*** | (2006.01) |
| ***E04G 1/14*** | (2006.01) |
| ***E04G 1/30*** | (2006.01) |

(52) U.S. Cl.

CPC ..... *E04G 1/14* (2013.01); *E04G 1/30* (2013.01); *E04G 2001/305* (2013.01)

(58) Field of Classification Search

CPC ..... E04G 1/14; E04G 1/30; E04G 2001/305; E04G 5/16

See application file for complete search history.

(56) References Cited

U.S. PATENT DOCUMENTS

| | | | | |
|---|---|---|---|---|
| 2,936,989 | A * | 5/1960 | Siek | E06C 7/16 248/238 |
| 2,966,957 | A * | 1/1961 | Ireland | E04G 1/28 182/152 |
| 3,011,586 | A | 12/1961 | Harvey | |
| 3,084,761 | A | 4/1963 | Robertson | |
| 3,190,406 | A | 6/1965 | Usher et al. | |
| 3,221,837 | A | 12/1965 | Fisher | |
| 3,326,507 | A * | 6/1967 | Sears | E06C 7/16 182/209 |
| RE26,354 | E | 2/1968 | Usher et al. | |

(Continued)

FOREIGN PATENT DOCUMENTS

| | | |
|---|---|---|
| GB | 2032504 A | 5/1980 |
| GB | 2210129 A | 6/1989 |
| GB | 2246066 A | 1/1992 |

*Primary Examiner* — Basil S Katcheves

(74) *Attorney, Agent, or Firm* — COATS & BENNETT, PLLC

(57) ABSTRACT

A scaffold includes first and second ladder frames. Each ladder frame includes first and second vertical supports, and first and second horizontal supports mounted to the vertical supports. The first horizontal support is formed of tubular material, and has a base or central section and an asymmetric flattened end section. The end section is mounted to the first vertical support. The central section has a top centerline and a bottom centerline. The end section has a vertically elongated cross section compared to the central section. A top of the end section aligns with the top centerline of the central section; and a bottom of the end section is disposed below the bottom centerline of the central section. Related methods and tools are also disclosed.

20 Claims, 11 Drawing Sheets

(56) References Cited

U.S. PATENT DOCUMENTS 3,491,852 A * 1/1970 Leist ..... E04G 1/15 182/120
3,551,011 A * 12/1970 Alley ..... E04G 7/305 52/645
3,586,128 A * 6/1971 Sandberg ..... E04G 1/28 182/229
3,892,290 A * 7/1975 Lang ..... E06C 1/52 182/163
4,074,792 A * 2/1978 Zaugg ..... E04G 5/04 182/117
4,542,874 A * 9/1985 Ronning ..... E06C 7/16 248/238
4,624,342 A * 11/1986 Anderson ..... E04G 5/06 182/119
4,782,914 A * 11/1988 Nail ..... E04G 5/14 182/113
4,823,913 A * 4/1989 Riegel, Jr. ..... E04G 1/38 182/225
4,901,650 A 2/1990 Armstead
4,941,547 A * 7/1990 Livick ..... E06C 7/48 182/229
5,099,953 A 3/1992 Stegath
5,145,030 A * 9/1992 Pavlescak ..... E04G 5/14 182/113
5,152,368 A * 10/1992 Heiden ..... E04G 5/00 182/222
5,152,371 A * 10/1992 Wyse ..... E04G 1/12 182/119
5,491,939 A * 2/1996 Wang ..... E04F 11/02 52/638
5,638,914 A * 6/1997 Kizzia ..... E04G 25/06 182/222
5,685,391 A * 11/1997 Gundlach ..... E06C 7/48 182/119
6,045,102 A * 4/2000 Terenzoni ..... E04G 5/06 248/237
6,119,810 A 9/2000 Harder
6,672,980 B1 1/2004 Walsh
6,732,836 B2 * 5/2004 Ono ..... E04G 5/147 182/113
7,168,580 B2 1/2007 Larimer et al.
2007/0088323 A1 * 4/2007 Campbell ..... A61M 25/10 604/523
2007/0220820 A1 9/2007 Chambers
2009/0236181 A1 9/2009 Tasse
2024/0035291 A1 * 2/2024 Smith ..... E04G 1/14

* cited by examiner

DETAIL VIEW - C

DETAIL VIEW - A

DETAIL VIEW - E

DETAIL VIEW - D

CRIMPING TOOL, CRIMPED PIPE WITH FLATTENED END, AND SCAFFOLD LADDER FRAME

This application claims benefit of U.S. Provisional Application No. 63/255,126, filed 13 Oct. 2021, the disclosure of which is incorporated herein by reference in its entirety.

TECHNICAL FIELD

The present disclosure relates generally to crimping tool for flattening the end of a pipe, and to a pipe with a flattened end formed by the crimping, and to a scaffold ladder frame that employs the pipe, and to related scaffolds and methods.

BACKGROUND

Scaffolds are commonly used in painting and other construction jobs, and traditionally allow a deck to be mounted at a desired elevation. A typical scaffold comprises two spaced-apart ladder frames connected by cross braces to form a self-supporting structure. Each ladder frame comprises two or more vertical posts interconnected by horizontal members that are welded to the vertical posts. It is known to flatten the ends of the horizontal members to provide facilitate stacking of the scaffold ladder frames when not in use. When the frames are vertically stacked, the vertical post on one ladder frame rests on the flattened ends of the horizontal members on the ladder frame immediately below to enable more compact stacking. See, for example, U.S. Patent Application Publication 2009/0236181.

While flattening the ends of the horizontal members facilitates stacking of the frames, the flattened ends tends to flare in both upward and downward directions. When a walkboard (or "platform") is laid on top of the horizontal member, one edge of the walkboard is lifted slightly due to the flaring at the ends of the horizontal member. Thus the wallboard cannot lie flat on the horizontal members.

In addition, the ladder frames typically include some intermediate horizontal members, typically on one latter half of the ladder frame, that act as ladder rungs. Flattening the ends of these ladder rungs to the same extent as the main horizontal members, while facilitating stacking, may result in relatively weaker weld joints.

As such, there remains a need for alternative approaches to forming scaffolds and/or scaffold ladder frames, preferably approaches that advantageously allow for better accommodation of the walkboard and/or that provide enhanced weld strength.

SUMMARY

The present disclosure is generally directed to a scaffolding and related products, tools, and methods that employ or help form an asymmetrically flattened section that allows for smaller stacking space to be consumed while advantageously allowing for welded joints to retain sufficient strength.

In one aspect, a scaffold is disclosed. The scaffold includes first and second ladder frames. Each ladder frame includes first and second vertical supports, and first and second horizontal supports mounted to the vertical supports. The scaffold also includes a plurality of cross braces, each configured to be releasably connected to both the first and second ladder frames to form a self-supporting scaffold. The first horizontal support is formed of tubular material, and has a central section and an asymmetric flattened end section. The end section is mounted to the first vertical support. The central section has a top centerline and a bottom centerline. The end section has a vertically elongated cross section compared to the central section. A top of the end section aligns with the top centerline of the central section; and a bottom of the end section is disposed below the bottom centerline of the central section. In some embodiments, 1) the horizontal support is formed of a first size tubular material; 2) the scaffold includes a least one rung, with the rung mounted to the vertical support; and 3) the rung is formed of a second size tubular material, the second size being smaller than the first size. Further, in some embodiments, 1) the end section includes a generally flat terminal section having a first width; 2) wherein the second size is larger than the first width; and 3) an end portion of the rung proximate the vertical support is narrowed to have a second width matching the first width.

In another aspect, a scaffold ladder frame is disclosed. The scaffold ladder frame includes at least one vertical support and a horizontal support formed of tubular material. The horizontal support has a central section and an asymmetric flattened end section, with the end section mounted to the vertical support. The central section has a top centerline and a bottom centerline. The end section has a vertically elongated cross-section compared to the central section, such that a top of the end section aligns with the top centerline of the central section, and a bottom of the end section is disposed below the bottom centerline of the central section.

In another aspect, a tool for making a pipe with a flattened end is disclosed. The tool includes upper and lower dies having cavities formed therein to flatten an end of tubular pipe section. The tubular pipe section has an undeformed base portion and an end portion. The cavity in each of the upper and lower dies has a first section shaped to conform to the base portion and a second section shaped to asymmetrically flatten the end portion to have an elongated cross-section relative to the base portion such that a top of the flattened end aligns with a top centerline of the base portion and a bottom of the flattened end extends below a bottom centerline of the base portion.

In another aspect, a method of forming a pipe with an asymmetric flattened end is disclosed. The method includes inserting a tubular pipe section into a crimping die, with the tubular pipe section having an undeformed base portion and an end portion. the method also includes compressing the end portion to form an asymmetrically flattened end with an elongated cross-section compared to the base section such that a top of the flattened ends aligns with a top centerline of the base section and a bottom of the flattened end extends below a bottom centerline of the base section.

In another aspect, a pipe for use in scaffolding is disclosed. The pipe includes a tubular section with central section and an asymmetric flattened end having an elongated cross-section. A top of the end section aligns with a top centerline of the central section, and a bottom of the end section extends below a bottom centerline of the central section.

Related methods, components, and combinations are also disclosed.

DETAILED DESCRIPTION

Figure 12:
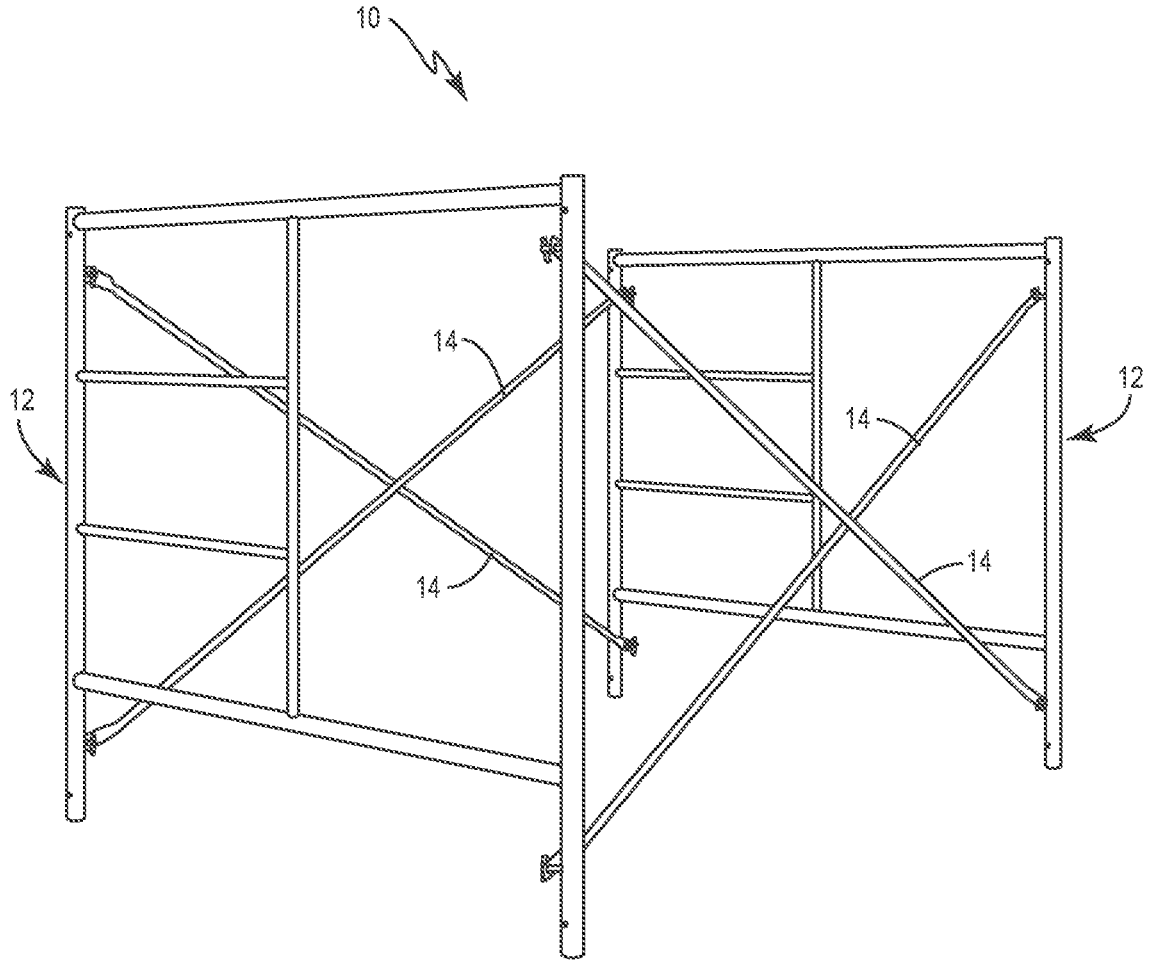
FIG. 12 is a perspective view of the scaffold with two ladder frames, with an optional walkboard omitted.

FIG. 12 illustrates a scaffold 10 according to an exemplary embodiment. The scaffold 10 comprises two spaced apart ladder frames 12 interconnected by removable cross braces 14 to form a rectangular scaffold 10. As will be hereinafter described, the scaffold 10 is designed to be broken down and stored in a compact space to reduce the volume occupied by the disassembled scaffold 10.

Figure 1:
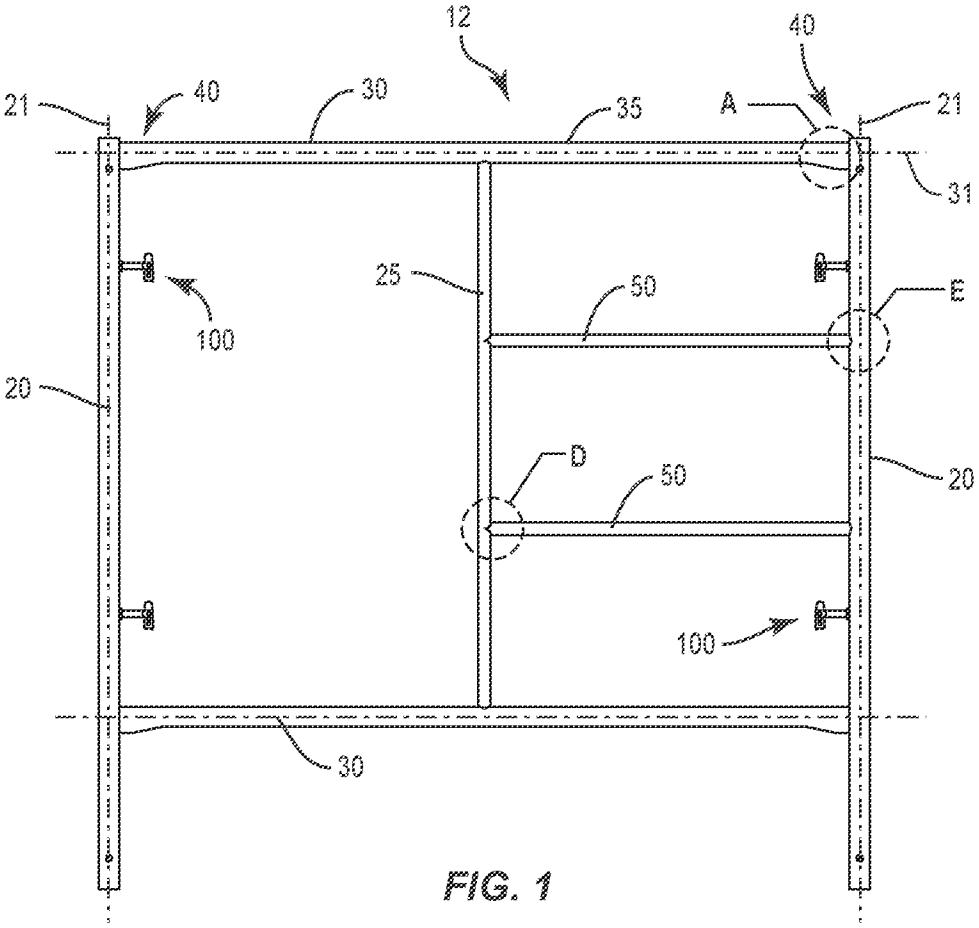
FIG. 1 shows a front view of a ladder frame of a scaffold of FIG. 12, with alternative placement of latch posts.

Each ladder frame 12 of the scaffold 10 comprises vertical supports 20, horizontal supports 30, an optional center support 25, and one or more optional ladder rungs 50 extending between one of the vertical supports 20 and the center support 25 to form a ladder for climbing the scaffold 10. See, e.g., FIG. 1. The vertical supports 20, horizontal supports 30, center support 25, and ladder rungs 50 are optionally all formed from metal tubular material. The cross-section of the tube is advantageously generally elliptical, with elliptical meaning oval, circular, or other generally round shape, which does not require a mathematically precise elliptical shape. In some embodiments, the generally elliptical cross-sections of the vertical supports 20, horizontal supports 30, center support 25, and/or ladder rungs 50 are circular. The cross braces 14 may comprise circular metal tubing with flattened ends where the cross braces 14 connect with the frames 12. The flattened ends may have openings formed therein that engage with inwardly projecting latch posts 100 on the vertical supports 20 of the ladder frames 12. Note that the latch posts 100 in FIG. 12 are shown in an alternative location compared with the latch posts 100 of FIG. 1; any suitable location may be used for the latch posts 100 based on desired stability, ease of manufacturing, or other considerations.

The vertical supports 20 each extend along a respective longitudinal axis 21 that is vertically oriented. The vertical supports 20 have latch posts 100 mounted thereto at appropriate locations, for mating with the cross braces 14 as discussed above. The vertical supports 20 optionally also include additional features, such as for receiving optional wheels, which are omitted from discussion herein in the interest of clarity.

The horizontal supports 30 each extend along a respective longitudinal axis 31 that is horizontally oriented. The horizontal supports 30 include a base or central section 35 disposed between the end sections 40. As mentioned above, the horizontal supports 30 are formed from metal tubing, which may have an elliptical cross-section. The central section 35 of the horizontal supports 30 has an upper or top centerline 36 on the upper surface parallel with the longitudinal axis 31, and a lower or bottom centerline 37 on the lower surface parallel with the longitudinal axis 31. Note that the longitudinal axis 31 is at the geometric center of the cross-section. Typically, there are two horizontal supports 30, one upper and one lower, but there may be other numbers of horizontal supports 30.

Figure 2:
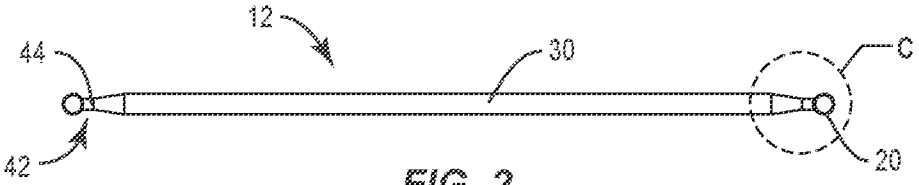
FIG. 2 shows a top view of the ladder frame of FIG. 1.
Figure 4:
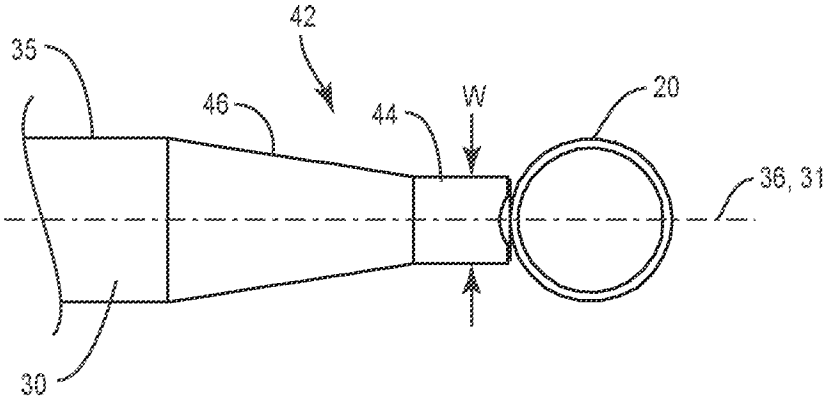
FIG. 4 shows a partial detail view of area C in FIG. 2.
Figure 3:
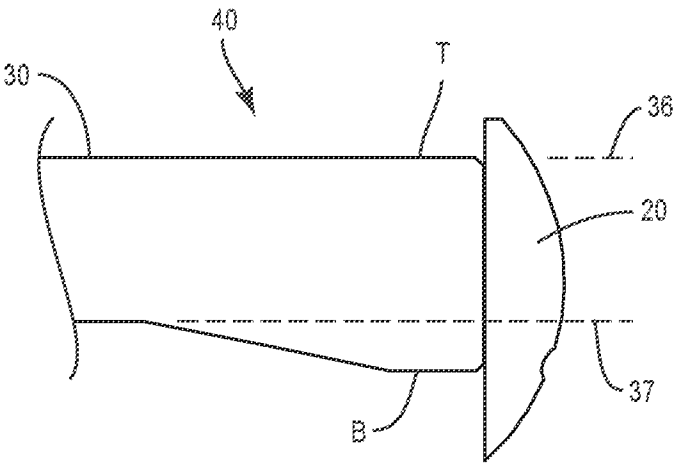
FIG. 3 shows a partial detail view of area A in FIG. 1.
Figure 6:
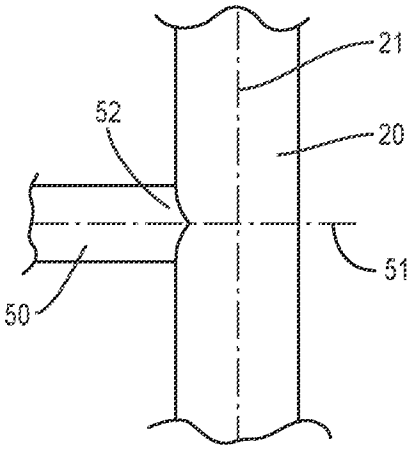
FIG. 6 shows a partial detail view of area E in FIG. 1.
Figure 5:
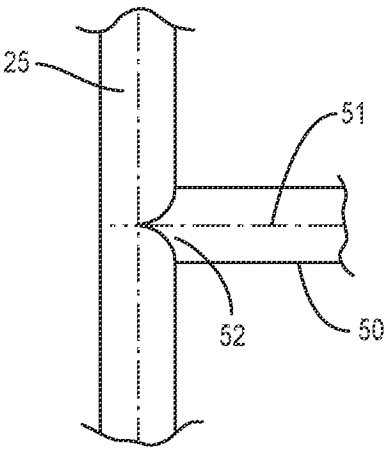
FIG. 5 shows a partial detail view of area Din FIG. 1.
Figure 7:
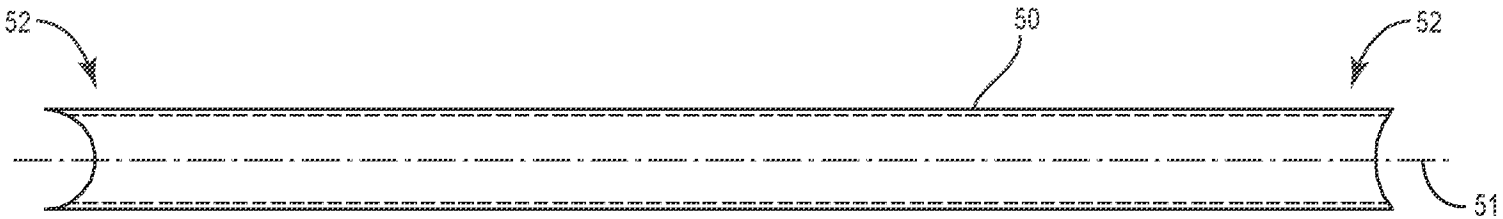
FIG. 7 shows a top view of a rung of the ladder frame of FIG. 1.
Figure 8:
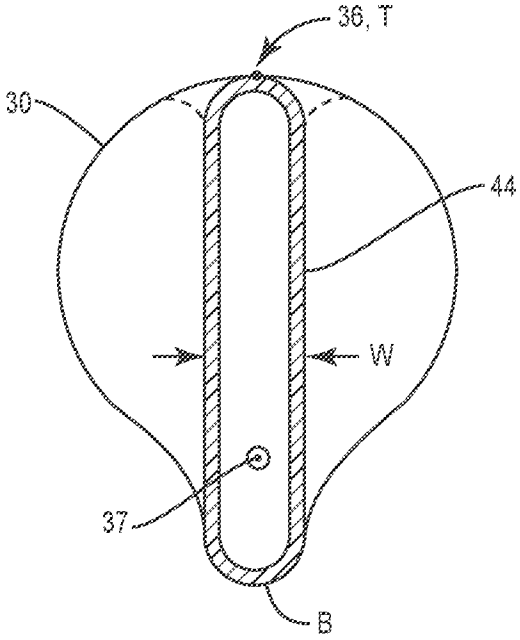
FIG. 8 shows an end view of a horizontal support for the ladder frame of FIG. 1.
Figure 9:
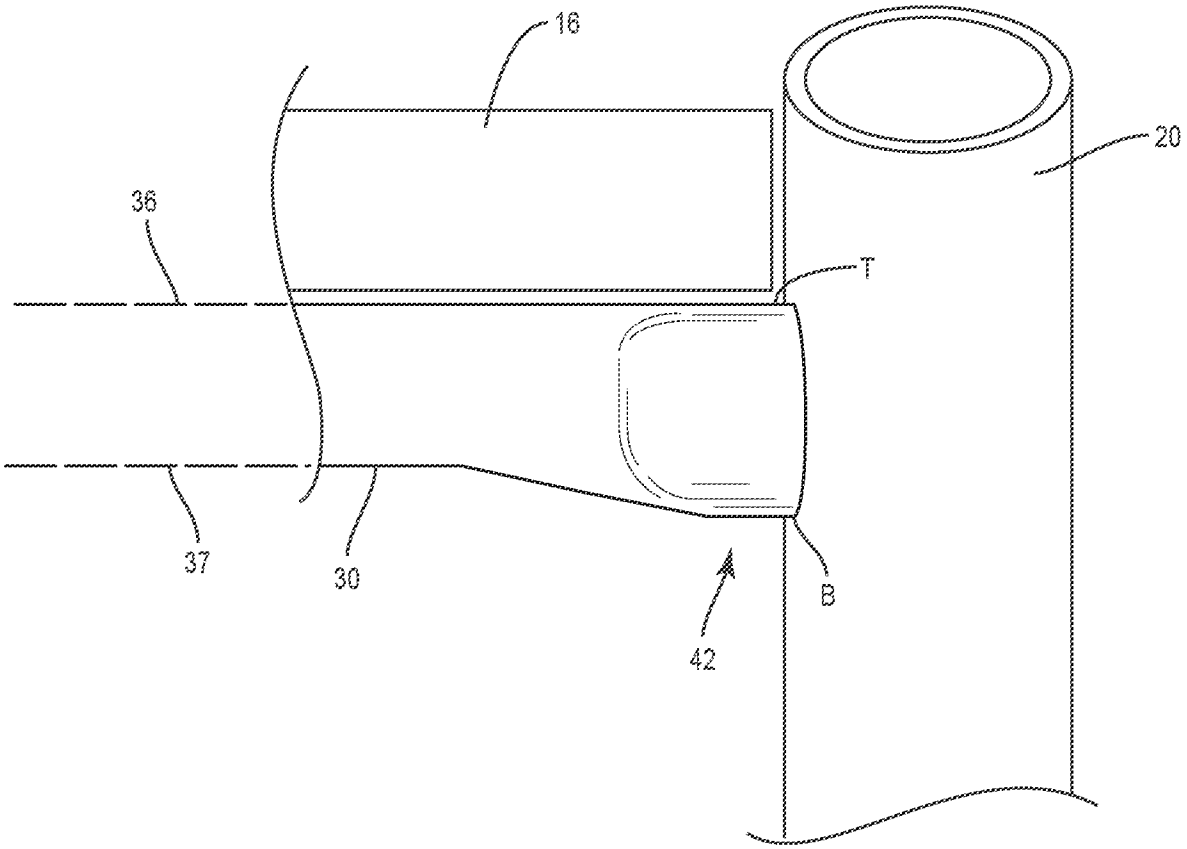
FIG. 9 shows a joint between a top horizontal support and a vertical support for the ladder frame of FIG. 1.

The respective end portions 40 of the horizontal supports 30 have flattened sections 42. The flattened sections 42 have a reduced dimension (width W) when viewed from above relative to the central section, see FIG. 2 and FIG. 4. Each flattened section 42 includes a relatively flat terminal section 44, and a transition section 46. The flat terminal section 44 has an elongated (e.g., oval) cross-section, and is the portion of the horizontal support 30 mounted to the vertical support 20. The terminal section 44 is advantageously formed by crimping the end of the tube forming the vertical support 20. The crimping is advantageously such that there remains a gap between the "sides" of the crimped section. That is, the terminal section 44 advantageously remains hollow. This shape aids in forming a good weld joint when the terminal section 44 is welded to the vertical support 20. It is intended that the terminal section 44 have a longitudinal length that is sufficient to properly receive a vertical support 20 of another ladder frame 12 when the ladder frames 12 are stacked. See FIG. 10. The transition section is disposed 46 between the terminal section 44 and the central section 35, and has a width that gradually narrows from the width of the central section 35 to the width W of the terminal section 44. It should be noted that the terminal section 44 is disposed asymmetrically about the longitudinal axis of the horizontal support 30. In particular, the top T of the terminal section 44 aligns with the top centerline 36 of the central section 35, but the bottom B of the terminal section 44 is disposed so that the bottom B of the terminal section 44 extends below the bottom centerline 37 of the central section 35. Thus, the flattened terminal section 44 extends downward from the central section 35, but does not extend upward from the terminal section 44. As such, the upper surface of the horizontal support 30 is at a consistent elevation, allowing a walkboard 16 placed thereon to rest firmly on the horizontal support 30 without being lifted off the horizontal support 30 near the joint of the horizontal support 30 to the vertical support 20. See FIG. 9. Accordingly, the corners of the walkboard 16 can "rest flat" on the horizontal support 30.

The optional center support 25 is disposed generally parallel to the vertical supports 20 in spaced relation to the vertical supports 20. The center support is advantageously mounted at its upper and lower ends to the horizontal supports 30.

Figure 10:
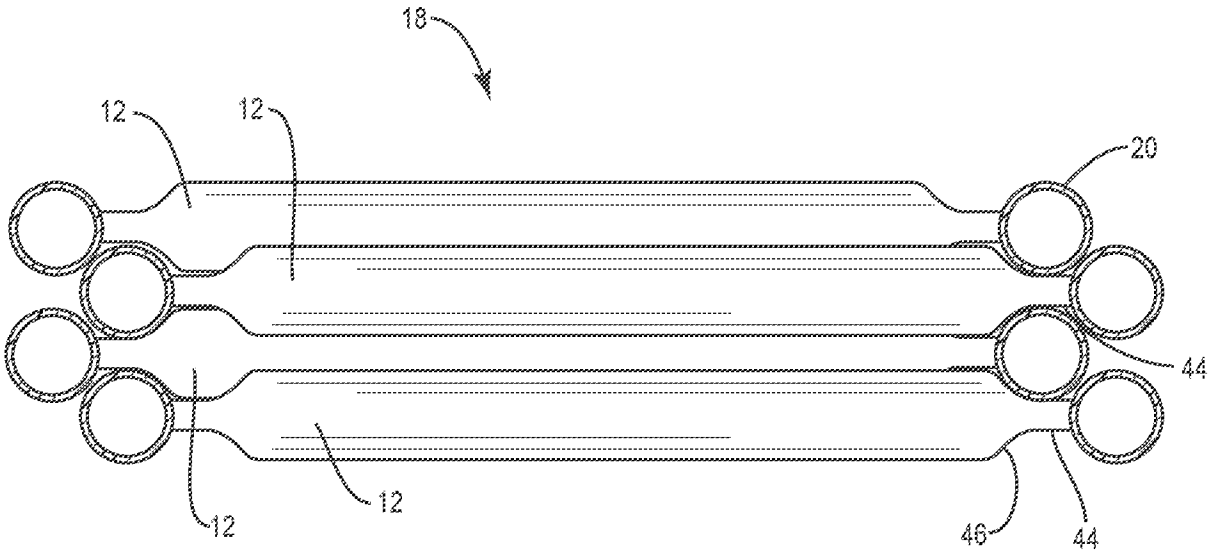
FIG. 10 shows a side view of a stack of a plurality of ladder frames, with the tops of the ladder frames facing the viewer.

As mentioned above, the ladder frame 12 advantageously includes one or more ladder rungs 50 that are mounted to center support 25 and one of the vertical supports 20, so as to be generally parallel to horizontal support 30 and spaced therefrom. The tubing of the ladder rung 50 extends along a corresponding longitudinal axis 51. In order to facilitate solid connections to the center support 25 and the vertical support 20, the ladder rung 50 is advantageously tube coped on each end 52 to mate up with the corresponding vertical element. The ladder rung 50 is welded on one end 52 to the center support 25 and on the other end to the vertical support 20. In some embodiments, the ladder rungs 50 are made of the same size tubing as the horizontal supports 30, and optionally include asymmetrically flattened terminal sections on their ends to aid in stacking ladder frames 12 in offset arrangement as shown in FIG. 10. However, the ladder rungs 50 may optionally be made from tubing that is smaller than the tubing forming the horizontal supports 30 and vertical supports 20. When the ladder rung 50 is made from smaller tubing, some space is provided for stacking another ladder frame 12 in offset arrangement as shown in FIG. 10. However, if the size of the tubing for the ladder rung 50 is larger than the thickness of the terminal section 44 of the horizontal support 30, the ladder rung 50 may cause the stacked ladder frames 12 to be vertically offset more than necessary when stacked because the vertical support 20 of the other ladder frame 12 may rest on the ladder rung 50 rather than on the terminal section 44. As such, some embodiments of the ladder frame 12 employ ladder rungs 50 that have one or both of their coped ends 52 slightly flattened. That is, the ends 52 are both coped and slightly flattened, in either order but advantageously coped and then slightly flattened. For example, if the thickness of the terminal section 44 is 22.2 mm, and the ladder rung 50 is formed of 25.4 mm diameter tubing, the coped end portions of the ladder rung 50 may be slightly flattened (e.g., by crimping) so that the slightly flattened end portion 52 mounted to the vertical support 20 (and optionally both ends 52 to facilitate manufacture) has a front-to-back width (into the page thickness for the FIG. 1 view) of 22.2 mm or less. With such embodiment(s), the vertical support 20 of the other ("top") ladder frame 12 may rest on both the ladder rung 50 and the terminal section(s) 44 of the ("bottom") ladder frame 12 when stacked. This allows for minimal height to be consumed by the stacked ladder frames 12.

In some embodiments, the ladder frame 12 does not include an center support and the ladder rungs 50 are mounted to a vertical support 20 on each end. Thus, the ladder rungs 50 are approximately as long as the horizontal supports 30 and reach from the vertical support 20 on one lateral side of the ladder frame 12 (for the orientation shown in FIG. 1) to the vertical support 20 on the other lateral side of the ladder frame 20.

In an exemplary embodiment, the vertical supports 20 and horizontal supports 30 can be formed of 41.3 mm diameter steel pipe. The vertical supports 20 may be about 1524 mm long and spaced about 1524 mm apart. The center support 25 may be formed of 25.4 mm diameter steel pipe, with 41.3 mm coping on each end. The ladder rungs 50 may be formed of 25.4 mm diameter steel pipe, with 25.4 mm coping on one end and 41.3 mm coping on the other end. The end of rung 50 with 41.3 mm coping may be slightly flattened to a thickness of about 22.2 mm. The upper horizontal support 30 may be placed so that the upper surface of the horizontal support 30 is about 9.8 mm down from the upper end of the vertical supports 20, and the lower horizontal support 30 may be located about 1143 mm from the upper horizontal support 30. The width (front to back thickness for the orientation of FIG. 1) of the terminal section 44 may be about 22.2 mm, and the terminal section 44 may be about 50 to 55 mm long in a direction parallel to longitudinal axis 31. The terminal section 44 may have a height (distance between top T and bottom B) of approximately 52 mm. Thus, by way of example, the ratio of height to width for the terminal section 44 may be approximately 2.5:1. In other embodiments, the width of the terminal section 44 may be about 16 mm, and the terminal section 44 may be about 50 to 55 mm long in a direction parallel to longitudinal axis 31. The terminal section 44 may have a height (distance between top T and bottom B) of approximately 56 mm. Thus, by way of example, the ratio of height to width for the terminal section 44 may be approximately 3.5:1. In other embodiments, the ratio of the height to width of the terminal section 44 may be approximately 1.8:1.

Figure 14:
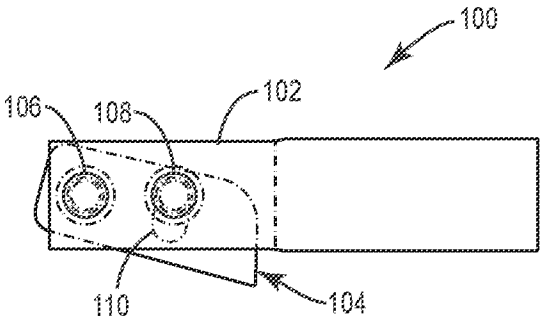
FIG. 13 and FIG. 14 show an exemplary latch post for connecting the cross brace to the vertical supports of the ladder frame.
Figure 13:
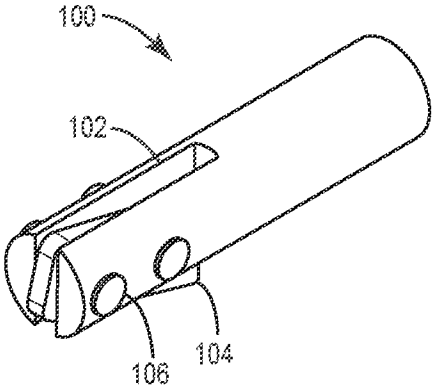

FIGS. 13-14 show an exemplary latch post 100. The latch post 100 includes a slot 102 to receive a locking member 104. The locking member 104 is secured in the slot 102 by a pivot pin 106 disposed at the outer end of the latch post 100. A second pin 108 is received in a slot 110 in the locking member 104. This arrangement allows the locking member 104 to drop down under the force of gravity and thus serve as a latch as to retain the cross brace 14 on the latch post 100. During assembly of the scaffold 10, the cross braces 14 engage with the latch posts 100 on the ladder frames 12 of the scaffold. The cross braces 14 optionally have flattened ends with openings formed therein. The openings in the ends of the cross braces 14 will pass over the latch posts 100 and push the locking member 104 upwardly. Once the opening in the cross brace 14 passes over the locking member 104, the locking member 104 will drop down under the force of gravity to latch the cross brace 14 and prevent it from disengaging. In some embodiments, the cross braces 14 may be unitary, and optionally pivotably connected together. However, in order to facilitate compact storage, the cross braces 14 may advantageously be telescoping and/or composed of multiple segments releasably connected in series.

Figure 11:
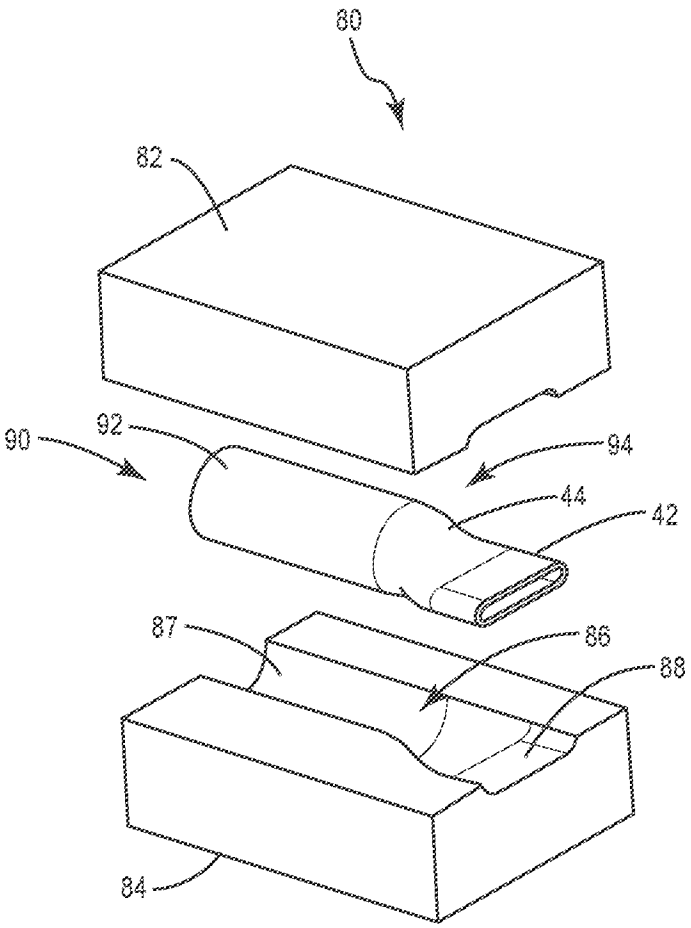
FIG. 11 shows a tool for forming a flattened end of a horizontal support, and a portion of the horizontal support so formed.

The end section(s) 40,52 of the horizontal support(s) 30 and/or the rungs 50 may be formed by crimping the end section(s) 40,52 with a suitable die tool. An example of a suitable tool for forming the end section 40 of the horizontal support 30 is shown in FIG. 11. The tool includes a first die half 82 and a second die half 84 that jointly form a die 80. Each of the die halves 82,84 have cavities 86 therein which are designed to receive the end of a tubular pipe section 90 from which the horizontal support 30 is formed. Conceptually, the tubular pipe section 90 has a base section 92 which remains undeformed in the crimping process, and an end portion 94. The cavities 86 of the first and second die halves 82,84 have a first section 87 and a second section 88. The first section 87 is shaped to conform to the base section 92 of the tubular pipe section 90. The second section 88 is shaped to asymmetrically flatten the end portion 94 to have an elongated cross-section relative to the base section 92. The deformation is such that the material of the tubular pipe section 90 is preferentially displaced, laterally in FIG. 11, in one direction over an opposing direction. The resulting elongated cross-section is such that a top T of the flattened end aligns with a top centerline 36 of the base section 92 and a bottom B of the flattened end extends below a bottom centerline 37 of the base section 92. If desired, the die 80 can be mounted to a die shoe on spacer blocks, and can be mounted by bolting, welding, or any other means known in the art. The use of the die 80 allows the crimping process to flatten the tubular material inserted therein in a consistent manner.

Figure 15:
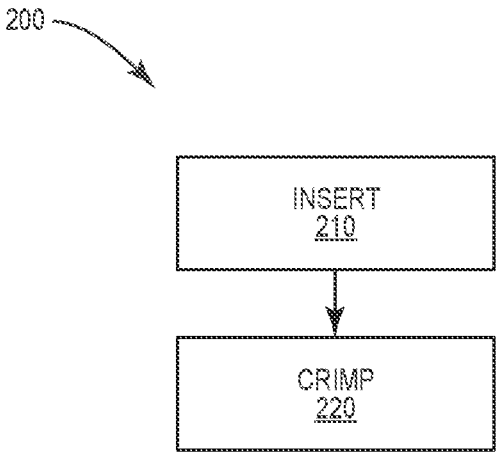
FIG. 15 shows a simplified flow diagram of a process of making a pipe with a flattened end.

Referring to FIG. 15, a process (200) for forming a pipe 90 with an asymmetric flattened end portion 94 includes inserting (210) a tubular pipe section 90 into a crimping die 80, with tubular pipe section 90 having an undeformed base section 92 and an end portion 94. The process also includes compressing (220) the end portion 94 to form an asymmetrically flattened end with an elongated cross-section compared to the base section 92 such that a top T of the flattened ends aligns with a top centerline 36 of the base section 92 and a bottom B of the flattened end extends below a bottom centerline 37 of the base section 92.

The formed horizontal support 30 is an example of a pipe for use in scaffolding. Such a pipe 90 includes a tubular section with central section 35 and an asymmetric flattened end having an elongated cross-section. A top T of the end section aligns with a top centerline 36 of the central section 35. and a bottom B of the end section extends below a bottom centerline 37 of the central section 35.

The presence of the flattened terminal sections 44 on the horizontal support 30 allows a plurality of ladder frames 12 to be stacked in a slightly staggered arrangement (see FIG. 10) while consuming less vertical space. This is because the vertical support 20 of one ladder frame 12 rests partially in a recessed area formed by the terminal section 44 of the ladder frame 12 below it, and partially in a recessed area formed by the terminal section 44 of the ladder frame 12 above it. Thus, a stack 18 of N ladder frames 12 has a height that is less than N times the "height" of the vertical supports 20 (measured normal to the longitudinal axis 21). In addition, having the flattened terminal sections 44 asymmetrically disposed relative to the longitudinal axis 31 of the horizontal support 30 allows the "hump" formed by the deformed material forming the terminal section 44 to be located on one side, e.g., the lower side, of the horizontal support 30, thereby avoiding having the walkboard 16 rest on the humps. Separately, or in addition, the optional slight flattening of one or both lateral ends 52 of the rungs 50 advantageously helps prevent the rungs 50 from adding to the height of the stack 18 of ladder frames 12 (by effectively reducing their "height" in the area where the vertical support 20 of another ladder frame 12 will be resting), and/or provides a good configuration for welding.

The present disclosure may, of course, be carried out in other specific ways than those herein set forth without departing from the scope and essential characteristics of the disclosure. The present embodiments are, therefore, to be considered in all respects as illustrative and not restrictive, and all changes coming within the meaning and equivalency range of the appended claims are intended to be embraced therein.

What is claimed is:

1. A scaffold ladder frame, comprising:

at least one vertical support;

a horizontal support formed of tubular material; the horizontal support having a central section and an asymmetric flattened end section, with the end section mounted to the vertical support; the central section having a top centerline and a bottom centerline; the end section having a vertically elongated cross-section compared to the central section;

wherein a top of the end section aligns with the top centerline of the central section; and wherein a bottom of the end section is disposed below the bottom centerline of the central section.

2. The scaffold ladder frame of claim 1, further comprising a walkboard supported by the horizontal support and overlapping the flattened end section.

3. The scaffold ladder frame of claim 1, wherein the end section is oriented perpendicular to a longitudinal axis of the horizontal support and parallel to a longitudinal axis of the vertical support.

4. The scaffold ladder frame of claim 1, wherein the central section has an elliptical cross-section.

5. The scaffold ladder frame of claim 4, wherein the central section has a circular cross-section.

6. The scaffold ladder frame of claim 1, wherein the end section of the horizontal support includes a generally flat terminal section having a width; and wherein the width is approximately half a diameter of the vertical support.

7. The scaffold ladder frame of claim 6, wherein a height to width ratio of the terminal section is about 1.8:1 to about 3.5:1.

8. The scaffold ladder frame of claim 1, wherein the horizontal support is formed of a first size tubular material;

further comprising at least one rung mounted to the vertical support in spaced relation to the horizontal support;

wherein the rung is formed of a second size tubular material, the second size smaller than the first size.

9. The scaffold ladder frame of claim 8:

wherein the end section includes a generally flat terminal section having a first width;

wherein the second size is larger than the first width;

wherein an end portion of the rung proximate the vertical support is narrowed to have a second width matching the first width.

10. The scaffold ladder frame of claim 8, wherein the ladder frame further comprises a center support disposed generally parallel to the vertical support, and wherein the rung is mounted to both the vertical support and the center support.

11. A scaffold, comprising:

first and second ladder frames, each comprising:

first and second vertical supports;

first and second horizontal supports mounted to the vertical supports;

a plurality of cross braces, each configured to be releasably connected to both the first and second ladder frames to form a self-supporting scaffold;

wherein the first horizontal support is formed of tubular material; the first horizontal support having a central section and an asymmetric flattened end section; the end section mounted to the first vertical support; the central section having a top centerline and a bottom centerline; the end section having a vertically elongated cross-section compared to the central section;

wherein a top of the end section aligns with the top centerline of the central section; and wherein a bottom of the end section is disposed below the bottom centerline of the central section.

12. The scaffold of claim 11, wherein the horizontal support is formed of a first size tubular material;

further comprising at least one rung, the rung mounted to the first vertical support so as to spaced from the horizontal supports of the corresponding ladder frame;

wherein the rung is formed of a second size tubular material, the second size smaller than the first size.

13. The scaffold of claim 12, wherein the end section includes a generally flat terminal section having a first width;

wherein the second size is larger than the first width;

wherein an end portion of the rung proximate the vertical support is narrowed to have a second width matching the first width.

14. The scaffold of claim 13, wherein the end portion of the rung proximate the vertical support is both coped and narrowed.

15. The scaffold of claim 12, wherein the first and second ladder frames further comprises a center support disposed generally parallel to the vertical supports of the corresponding ladder frame; and wherein the rung is mounted to both the first vertical support and the center support of the corresponding ladder frame.

16. The scaffold of claim 12, wherein the second size is about 60% of the first size.

17. The scaffold of claim 12, wherein there are at least two rungs for each ladder frame.

18. The scaffold of claim 11, further comprising a walkboard configured to be supported by the first horizontal supports of the first and second ladder frames.

19. The scaffold of claim 11, wherein the second horizontal supports also have asymmetric end sections.

20. The scaffold of claim 11, wherein the asymmetric flattened end section has a height to width ratio of about 1.8:1 to about 3.5:1.

* * * * *